United States Patent [19]

Nishioka

[11] Patent Number: 4,696,281

[45] Date of Patent: Sep. 29, 1987

[54] PROJECTILE SHOOTING GUIDE FOR BOWS

[76] Inventor: Jim Z. Nishioka, 1268 Hemlock NW., Salem, Oreg. 97304

[21] Appl. No.: 915,421

[22] Filed: Oct. 6, 1986

[51] Int. Cl.[4] ..... F41B 5/00

[52] U.S. Cl. ..... 124/25; 124/26; 124/86

[58] Field of Search ..... 124/25, 24 R, 26, 23 R, 124/86, 81

[56] References Cited

U.S. PATENT DOCUMENTS

| | | | |
|---|---|---|---|
| 1,526,176 | 2/1925 | O'Connell . | |
| 2,125,591 | 8/1938 | Smith . | |
| 2,313,803 | 3/1943 | Carlson | 124/25 |
| 2,362,065 | 11/1944 | Hagopian | 124/26 |
| 3,031,797 | 5/1962 | Gelfand | 124/26 |
| 3,224,141 | 12/1965 | Borak | 124/26 |
| 3,483,857 | 12/1969 | Jones | 124/25 |
| 3,572,311 | 3/1971 | Baer . | |
| 4,027,645 | 6/1977 | Damron . | |
| 4,146,009 | 3/1979 | Adams . | |
| 4,169,456 | 10/1979 | Van House | 124/25 |
| 4,291,664 | 9/1981 | Nishioka . | |
| 4,385,618 | 5/1983 | Nishioka . | |
| 4,446,844 | 5/1984 | Nishioka | 124/24 R |
| 4,573,445 | 3/1986 | Webb et al. | 124/86 |

*Primary Examiner*—Richard J. Scanlan, Jr.
*Assistant Examiner*—Peter M. Cuomo

[57] ABSTRACT

An elongated guide member is positioned on a bow and extends longitudinally in a direction of shooting motion of the bow's bowstring. The guide member includes elongated parallel portions for guiding both short projectiles and arrows. A short projectile is provided which slidably engages the parallel portions. The guide member also includes projections which engage recesses in the support. The guide member also includes a resilient element to allow passage of oversized or deformed projectiles. A projectile includes a groove or slot extending longitudinally along the body portion of the projectile. Another projectile has elongated ridges positioned at the base of its wings. Another embodiment of the guide employs rod-like parallel portions.

5 Claims, 24 Drawing Figures

PROJECTILE SHOOTING GUIDE FOR BOWS

FIELD OF THE INVENTION

This invention relates to new and useful improvements in projectile shooting guides and projectiles for bows.

SUMMARY OF THE INVENTION

According to the present invention and forming primary objectives thereof, projectile shooting guides and projectiles for bows are provided having novel structural arrangements.

Archery bows employ arrows or bolts which are of sufficient length to extend to or beyond the bow's forward end. These arrows are expensive but are desirable for certain hunting and target situations.

Prior structures position short projectiles on top of guide members, however, they do not control upward movement of such projectiles during their movement on the guide member.

Furthermore, with the increasing use of the extended or forwardly positioned trigger mechanism, the distance between the forward end of the bow and the nut has increased.

Prior structures employed to shoot balls do not have any means to compensate for oversized or deformed balls. Lead-based balls are the most readily available and the most economical, however, are seldom perfectly round and are easily damaged. Imperfect balls can easily jam in prior structures. Furthermore, prior bows or shooting guides were not capable of selectively shooting balls or arrows.

An objective of this invention is to provide a bow which can selectively shoot arrows or short projectiles positioned on top of the guide member and such short projectile's upward movement being controlled during its movement in the guide member.

Another objective of the present invention is to provide a projectile with a downwardly extending portion to slidably engage the guide member.

Another objective of this invention is to provide a combination of a bow and a projectile shooting guide with means on the bow to attach such shooting guide to the bow.

Another objective of this invention is to provide a guide member with a projective guide path which will expand to accommodate oversized or deformed balls.

Another objective of this invention is to provide a guide member which can be raised or lowered for selective positioning.

Still another objective of this invention is to provide a projectile with an elongated slot or groove positioned adjacent to the wings of the projectile.

The invention will be better understood and additional objectives and advantages will become apparent from the following description taken in connection with the accompanying drawings.

DETAILED DESCRIPTION OF PREFERRED EMBODIMENTS

Figure 1:
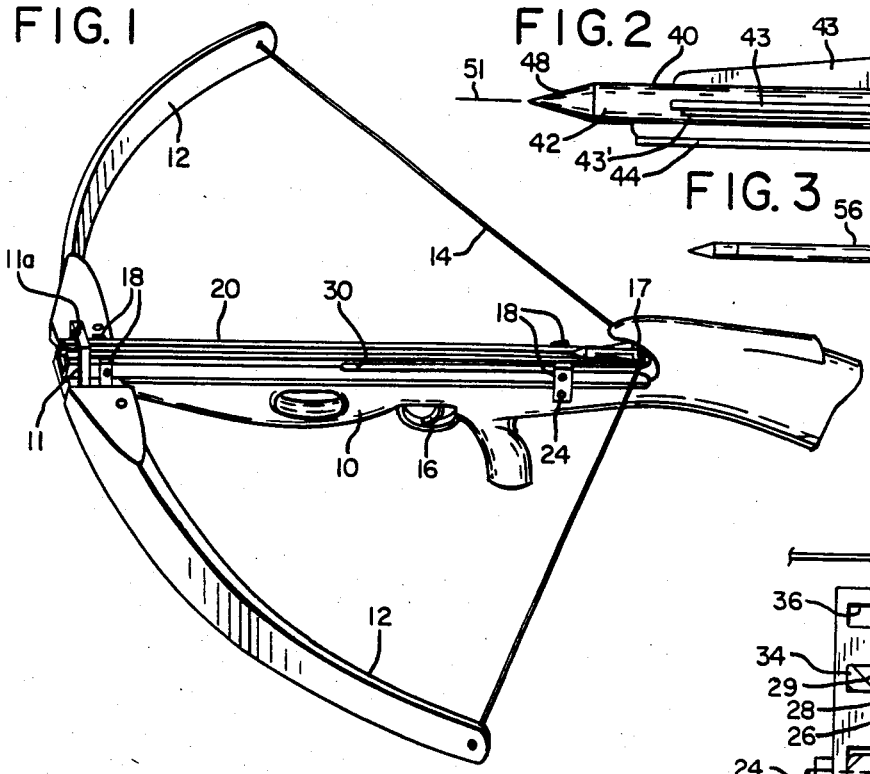
FIG. 1 is a perspective view of the bow and a first form of shooting guide and projectile embodying principles of the present invention.

The shooting guides and projectiles of this invention illustrated in the drawings are shown associated with an archery bow of the crossbow type. However, it is to be understood that the structural principles involved in the shooting guides and projectiles of this invention may be included with archery bows other than crossbows.

With particular reference to the drawings, and first to FIGS. 1–11, there is shown an archery bow having a frame or stock 10, a web or ramp 11, sight **11*a*, and a prod 12 or other forms of tensioning means. A bowstring 14 is connected to the prod. The bowstring includes an arrow or projectile engaging portion 14*a*. The bow has a trigger 16 and a nut or bowstring catch 17**.

The projectile shooting guide of the present invention is designed for use with archery bows as shown, and it is to be understood that it could be used for other types of bows. The guide comprises brackets 18, a guide member 20, elongated parallel portions 20' of the guide member, a bore 22, a bolt 24, a resilient device such as foam rubber 26, a rigid plate 28, elongated ridges 29, bowstring slots 30, pins 32, projections 34 on the guide member best seen in FIG. 7, recesses 36 on brackets 18, and a bolt 38 which locks the guide member in position. The web or ramp 1 forms a hood over the guide member 20 and supports the sight 11*a*. Such ramps are commonly used with extended or forwardly positioned trigger mechanisms.

Figure 2:
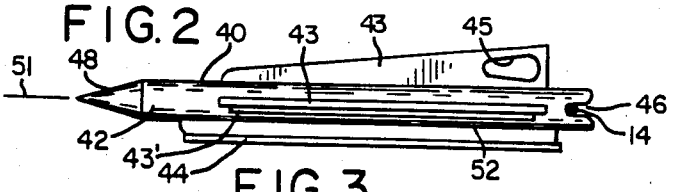
FIG. 2 is a side elevational view of a projectile embodying principles of the present invention.

A projectile 40 is provided for use with the guide, such projectile is best seen in FIG. 2. The projectile includes a body portion 42, outwardly extending wings 43, a downwardly extending portion 44, a bore or opening 45 through an outwardly extending portion, a bowstring nock 46, and a head portion 48. The projectile also includes a horizontal center indicated by a line 50 seen in FIG. 7 and a vertical center indicated by a line 51 seen in FIG. 2. The downwardly extending portion 44 includes slots or grooves 52 which extend along both sides of the projectile.

The downwardly extending portion 44 of the projectile is split and its ends tapered which allows such portions to compress when the projectile is loaded. This is indicated by broken line 44' shown in FIG. 7. This allows the projectile to be loaded into the middle portion of the top portion of the guide member. This is believed to be an important feature of the invention. Obviously, the projectile also can be loaded into the front of the guide member.

Figure 3:
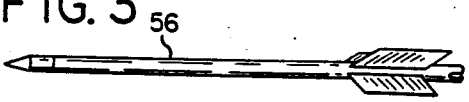
FIG. 3 is a side elevational view of a conventional arrow.
Figure 8:
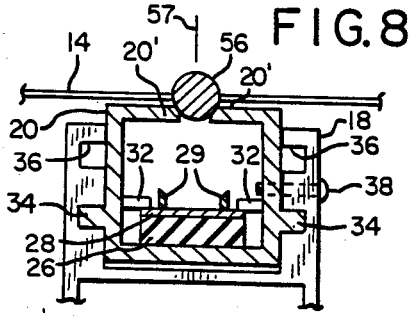
FIG. 8 is a fragmentary sectional view of the guide member with a conventional arrow in a loaded position on the guide member.
Figure 5:
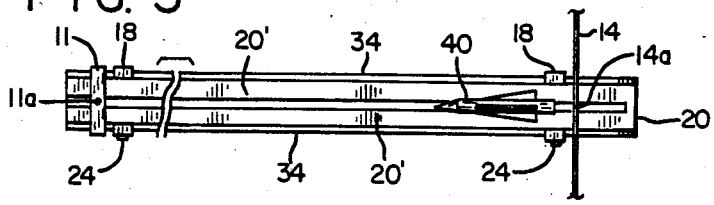
FIG. 5 is an overhead view of the guide member shown in FIG. 4 but without the optional structure for supporting arrows.
Figure 6:
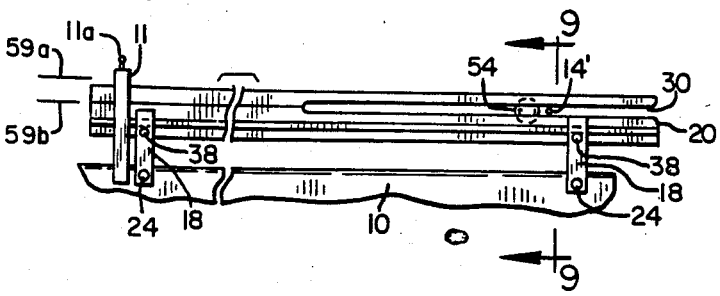
FIG. 6 is a side elevational view of the guide member in a raised position with the bowstring positioned in the bowstring slot and a ball loaded in the lower projectile pathway.
Figure 9:
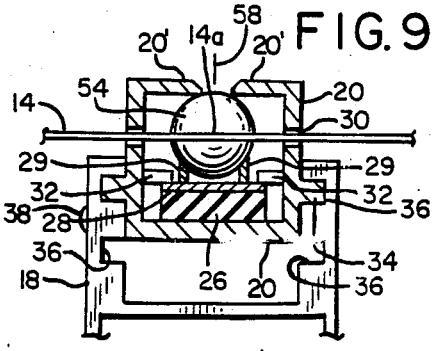
FIG. 9 is an enlarged fragmentary sectional view taken on line 9—9 of FIG. 6.

Other projectiles for use with the guide include a ball 54 seen in FIG. 9, and a conventional arrow 56 shown in FIG. 3. Such arrow includes a horizontal center indicated by a line 57 seen in FIG. 8. The ball includes a horizontal center indicated by a line 58 seen in FIG. 9.

Figure 7:
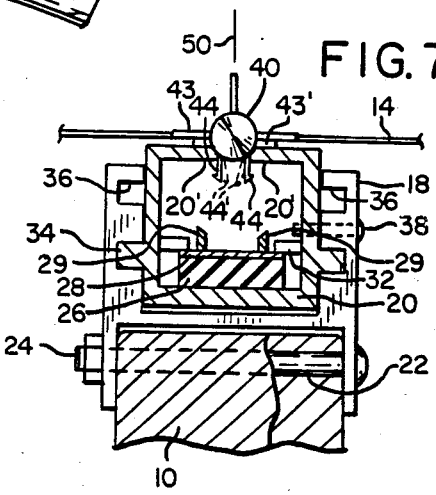
FIG. 7 is an enlarged fragmentary sectional view of the guide member, partly broken away, taken on line 7—7 of FIG. 4.

Referring to FIG. 7, the bow includes the bore 22 in the stock 10 which provides a means to attach the guide member 20 to the bow. A bolt 24 passes through the bracket 18 and the bore 22. The bore can be pre-drilled into the bow during manufacture.

The guide member 20 is slidably supported on the stock 10 by brackets 18 and can be selectively positioned in a lower or an upper position by engaging the projections 34 of the guide member in the recesses 36 of the supports. When the guide member is positioned in the lower position, best seen in FIG. 7, the bowstring 14 extends transversely across the top of the guide member. The portion 44 of the projectile 40 extends downwardly between the elongated parallel portions 20' of the guide member. In other words, the downwardly extending portion 44 extends downwardly into the top of the guide member. The parallel portions provide a track to guide the conventional arrow 56 as shown in FIG. 8 and the projectile 40 as shown in FIG. 7. The outwardly extending wings 43 of the projectile help stabilize such projectile in flight. The bowstring 14 engages the projectile 40 above the engagement of the portions 44 and the parallel portions 20'.

A desirable feature of this invention is that at least a substantial portion of the body portion 42 of the projectile 40 is positioned on top of the elongated parallel portions 20' of the guide member 20. This allows the shooter to visually assess the position and the condition of such projectile. The projectile also can be easily grasped to move it into a shooting position. Furthermore, the positioning of the projectile body portion on the top of the parallel portions of the guide member positions the mass of such projectile in alignment and on substantially the same horizontal plane as the bowstring. This promotes smooth acceleration and launch of the projectile with a minimum of friction. The horizontal plane of the projectile and the bowstring is indicated by a line 59*a* seen in FIG. 6.

When the projectile 40 is loaded on top of the guide member 20, the downwardly extending portion 44 positioned on the bottom of the projectile body portion 42 slidably engages the bottom portions of the parallel portions 20' of the guide member 20. Such engagement of the projectile and the guide member controls or restricts the projectile's upward, turning and lateral movements as it is propelled from the guide member by the bowstring. Furthermore, such engagement of the projectile and the guide member is positioned below the vertical center 51 of the projectile. the positioning of the projectile 40 on top of the guide member 20 and its controlled engagement to such guide member is believed to be a novel feature of the invention.

When the projectile is propelled forwardly by the bowstring it cannot lift off of the guide member and possibly strike the front of the bow or the sight ramp 11 and richohet back towards the shooter or others standing nearby. Such control of the projectile's lateral and upward movements during its sliding movement on the top of the guide member is an important safety feature. This feature is especially significant when metal heads are employed on the projectiles.

The fact that the elongated parallel portions 20' can guide either the conventional arrow 56 shown in FIG. 8 or the projectile 40 shown in FIG. 7 is believed to be another novel feature of this invention. This enables the archer to selectively shoot conventional arrows or economical short projectiles.

Furthermore, with the preferred type of bow shown in FIG. 1, the archer can select either the arrow or the projectile after the bowstring is drawn and engaged to the nut. He can also switch from arrow to projectile or projectile to arrow after the bowstring is drawn.

Referring to FIG. 2, the wing 43 includes an opening 45 to reduce the mass of the rearward portion of the projectile and to help stablize such projectile in flight. The opening also provides a convenient means to carry and to display the projectile.

Elongated ridges or shoulders 43' extend longitudinally on the bottom wings 43 and space the outer edges of the wings apart from the parallel portions 20' of the guide member. Such outer edges of the wings are easily damaged on impact with a target. Burred or damaged wings can cause friction between the projectile and the parallel portions and result in loss of projectile speed. The fact that the ridges or shoulders 43' space the wings away from the parallel portions reduces such projectile speed loss when projectiles with damaged wings are employed.

Referring to FIG. 9 the guide member 20 is shown in the raised position. The user can raise the guide member to this position by loosening the bolt 38 and removing the guide member from the brackets 18. The bowstring slot 30 has a closed forward end and an open rearward end, such open rearward end allowing the guide member to be removed without disengaging the bowstring from the bow. The guide member is then re-engaged to the brackets in the raised position. This aligns the bowstring 14 transversely through the slots and allows normal shooting movements of such bowstring.

Furthermore, if desired, the bowstring 14 may be moved to the slot 30 by sliding the guide member 20 rearwardly and then depressing the bowstring to align it with the slot and then re-seating the guide member.

The ball 54 is shown in a loaded position. The rigid plate 28 includes elongated ridges 29 which extend longitudinally in the guide member, such ridges forming a track for supporting and guiding the ball. The rigid plate 28 rests on the resilient device 26 and is restricted in its upward movement by pins 32. The resilient device urges the plate and the ridges upwardly but will yield in a downwardly direction to allow oversized or deformed balls to pass through the guide member.

Projectile pathways in embodiments of this disclosure are the areas which are occupied by a projectile when it is loaded into a guide member and shot.

The pins 32 may be bent to adjust the size of the pathway. Other structures, such as adjustable bolts extending through the rigid plate 28 and the resilient device 26, may be employed to accomplish the same function.

Lead balls are economical to shoot and are readily available in the market place, however, they are seldom perfectly round and are easily damaged. A desirable feature of this guide member is that the projectile pathway will expand to accommodate slightly imperfect or damaged balls.

The horizontal plane of the bowstring 14' and the ball 54 is indicated by a line **59*b***.

Figure 4:
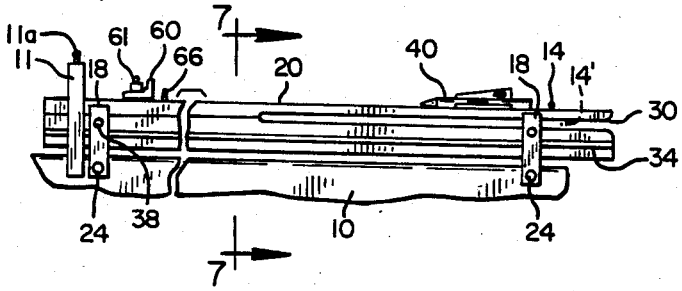
FIG. 4 is an enlarged side elevational view of the guide member shown in FIG. 1 with an optional structure for supporting arrows.
Figure 10:
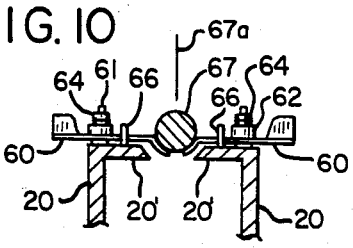
FIG. 10 is a sectional view of the guide with the optional structure for supporting arrows shown in FIG. 4 with an arrow shown in a loaded position and supported by the structure.
Figure 11:
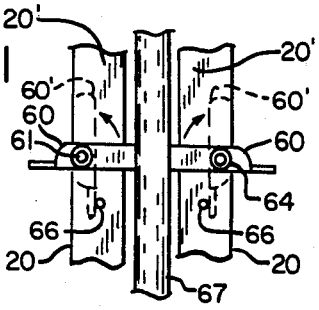
FIG. 11 is an overhead view of the guide member, the arrow and the supporting structure shown in FIG. 10.

Referring to FIGS. 10 and 11 a structure for supporting an arrow is shown for use on the guide member 20. The structure includes pivotable portions 60, studs 61, resilient element such as rubber washer 62, nuts 64 and pins 66. This structure is for use when thin-shafted arrows such as 67, seen in FIG. 10, are used. Such arrow is similar to that shown in FIG. 3, however, the shaft diameter is smaller. The arrow includes a lateral center indicated by line **67*a*. Without the structure shown, such narrow-shafted arrow would fall between the elongated parallel portions 20'. When employing short projectiles the pivotable portions 60 may be pivoted to a retracted or non-operative position indicated by broken line 60'. In the event a projectile is inadvertently shot with the structure in an operative position shown in FIG. 10, the projectile will strike the pivotable members 60 and cause them to pivot to the position indicated by broken line 60', thus allowing the projectile to pass through. Pin 66 limits the pivoting movements of the pivotable portions. This structure also allows wider spacing of the parallel portions 20' for use with wider bodied projectiles. The positioning of this optional structure on the guide member 20 is shown in FIG. 4**.

Figure 12:
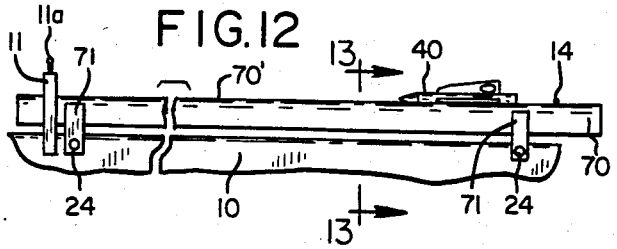
FIG. 12 is a modified form of shooting guide embodying principles of the present invention.
Figure 13:
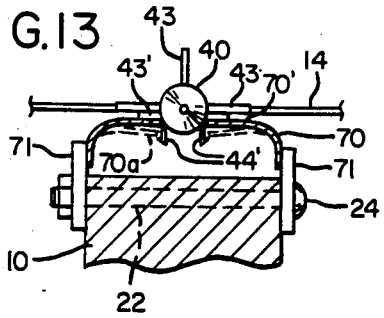
FIG. 13 is a sectional view taken on line 13—13 of FIG. 12.

Referring to FIGS. 12–13 there is a simplified modification of the shooting guide shown in FIG. 7. This modification is an important embodiment of the invention. The ball shooting portion of the embodiment of FIG. 7 is not included. The guide member 70 and bracket 71 are attached to the stock 10 by the bolt 24. The bow includes the bore 22 to receive such bolt which provides a means to attach the guide member to the bow. The guide member 70 includes elongated parallel portions 70' which provide a track for slidably supporting the projectile 40 or the conventional arrow 56 shown in FIG. 3.

Similar to the embodiment shown in FIG. 7 the engagement of the projectile 40 to the parallel portions 70' restricts or controls lateral and upward movements of the projectile when it is shot from the guide member. Furthermore, the archer can selectively shoot the arrow 56 shown in FIG. 3 or the projectile 40 shown in FIG. 13. The projectile 40 and the arrow 56 are positioned on top of the guide member 70. The engagement of the projectile 40 to the parallel portions 70' is positioned below the vertical center 51 of the projectile.

The parallel portions 70' are flexible. When the projectile 40 is placed on the parallel portions and pressed downwardly the parallel portions will flex to the position indicated by broken line **70*a***. This allows the projectile to be loaded into the middle portion of the guide member. This is an important convenience feature.

Figure 14:
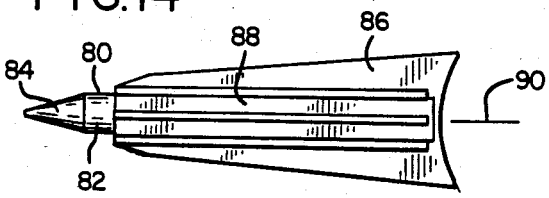
FIG. 14 is another form of projectile embodying principles of the present invention.
Figure 16:
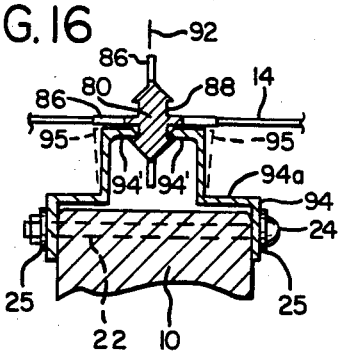
FIG. 16 is a sectional view taken on line 16—16 of FIG. 15.
Figure 15:
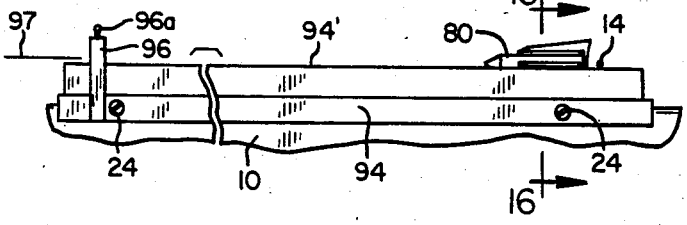
FIG. 15 is another form of a shooting guide embodying the principles of the present invention.

With reference to the embodiment shown in FIGS. 14–16 a projectile 80 has a body portion 82, a head 84, outwardly extending portions or wings 86, grooves 88 and a vertical center of the projectile indicated by line 90. The horizontal center of the projectile is indicated by line 92. A guide member 94 includes inwardly extending portions **94*a* and elongated parallel portions 94', such parallel portions forming a track for the projectile 80 or the conventional arrow 56. The guide is attached to the bow stock 10 by bolt 24 which passes through bore 22 in the stock. The guide also includes a web or ramp 96 which supports a sight 96*a*. The horizontal plane of the bowstring 14 and the projectile 80 is indicated by line 97. The grooves 88 of the projectile are positioned adjacent to and at the base of the wings 86. The positioning of the wings relative to the grooves protects such grooves from damage on impact when the projectile is shot. This guide member allows the archer to selectively shoot the conventional arrow 56 seen in FIG. 3, the projectile 40 shown in FIG. 2 or the projectile 80 as shown in FIG. 14. Resilient element 25 allows movement of guide member 94**.

The guide member is flexible and this is indicated by broken line 95. This allows the projectile to be loaded into the middle of the top of the guide member. Furthermore, the guide member positions the parallel portions 94' inwardly of the outside edges of the projectile wings which allows the projectiles with slightly damaged wings to be shot without loss of speed. This feature also provides easy grasping of the projectile to slide it into the desired position on the guide member. The rearward portions of the top and bottom wings 86, best seen in FIG. 14, form the bowstring engaging portion of the projectile. The top and bottom wing bases are tapered for easy loading.

The engagement of the grooves 88 to the elongated parallel portions 94' allows the projectile to slide but restricts or controls its lateral and upward movements on top of the guide member when it is shot.

Figure 18:
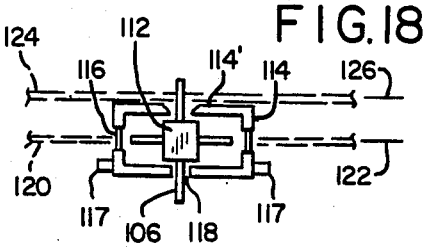
FIG. 18 is a sectional view of another form of shooting guide embodying principles of the present invention.
Figure 17:
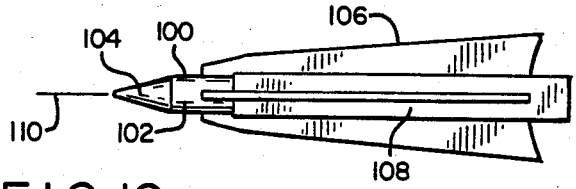
FIG. 17 is another form of projectile embodying principles of the present invention.

Referring to the embodiment shown in FIGS. 17–18 a projectile 100 includes a body portion 102, a head 104, outwardly extending wings 106, ridges or shoulders 108, a vertical center indicated by line 110 and a rearward end of the projectile 112. A guide member 114 includes elongated parallel portions 114', bowstring slots 116, projections 117, and a slot 118 for allowing passage of a lower projectile wing 106. The elongated parallel portions 114' form a track for the projectile 80 or the conventional arrow 56 shown in FIG. 3. A bowstring 120 is shown in broken lines and aligned with the projectile 100.

A horizontal plane of the projectile and the bowstring is indicated by line 122. The position of the bowstring 124 is shown in broken line and in an upper position for shootthe conventional arrow 56 sown in FIG. 3 or the projectile 40 shown in FIG. 2 or the projectile 80 shown in FIG. 14. A horizontal plane of the bowstring 124 and the conventional arrow or the projectiles 40 or 80 is indicated by line 126. The ridges or shoulders 108 are tapered for easy loading.

The guide member 114 is suitable for use with the brackets 18 shown in the embodiment of FIG. 7. The guide member can be modified to slide and lock in a manner similar to the guide member 20 and have an open ended slot similar to that shown in FIG. 4.

The shoulders or ridges 108 of the projectile 100 engage the guide member and isolate the outer edges of the wings 106. Similar to the embodiments shown in FIGS. 13 and 16, slight damage or burring of the such outer edges of the wings will not cause significant loss of speed or jamming when the projectile is shot from the guide member.

The engagement of the wings 106 and the ridges 108 to the guide member 114 controls or restricts the projectile's upward and lateral movements as it slides in the guide member when it is shot.

The archer can selectively use the projectile plane indicated by line 122 or the upper plane indicated by line 126. In the upper plane or top of the elongated parallel portions 114' the archer can shoot the conventional arrow 56 shown in FIG. 3, the projectile 40 shown in FIG. 2 or the projectile 80 shown in FIG. 14.

Figure 19:
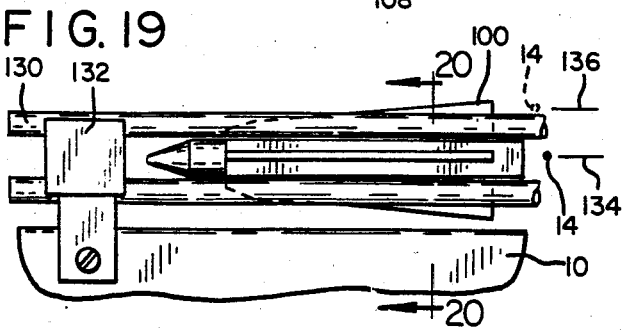
FIG. 19 is another form of a shooting guide embodying the principles of the present invention.
Figure 20:
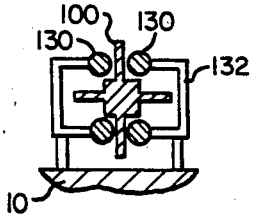
FIG. 20 is a sectional view taken on line 20—20 of FIG. 19.
Figure 21:
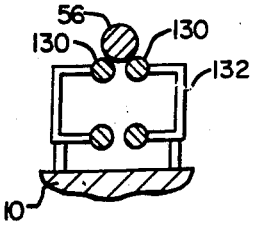
FIG. 21 is a sectional view of the shooting guide shown in FIG. 20 with an arrow shaft.

Referring to FIGS. 19–21 a projectile shooting guide includes four elongated parallel portions or bars 130 which are secured together with a web 132, such web being secured to the stock 10. The projectile 100 shown in FIG. 17 is shown positioned in the guide. This guide is very simple in construction and allows good visual inspection of the projectile. Furthermore, the projectile is easy to grasp for positioning on the parallel portions. The wings of the projectile extend beyond the parallel portions. The bowstring 14 is shown aligned with the projectile and this alignment is indicated by line 134. The bowstring can be disconnected from the bow and aligned on the top of the guide member, such alignment is indicated by line 136. In this position the guide member will guide the conventional arrow 56 shown in FIG. 3, such arrow being shown on the top of the guide member in FIG. 21. This allows the archer to selectively shoot conventional arrows or short projectiles.

The parallel portions are shown in a rod-like form, however, other forms such as elongated flat-sided portions may be employed. The top two parallel portions may be modified to be detachable or slide so that the archer can move the bowstring to the upper alignment without removing the bowstring from the bow. The two bottom bars form a projectile track for slidably supporting the projectile 100.

The engagement of the projectile with the parallel portions allows free sliding movement of the projectile while restricting its upward and lateral movements when it is shot from the guide member by the bowstring.

Other projectiles such as the projectile 80 shown in FIG. 14 may be employed in the lower position. Furthermore, other modified projectiles such as those with round bodies or three wings may be employed with this embodiment of the invention.

Figure 24:
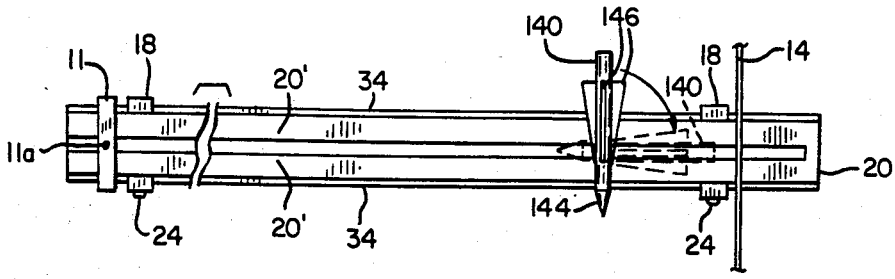
FIG. 24 is an overhead view of the projectile shown in FIG. 22 positioned on the guide member.
Figure 22:
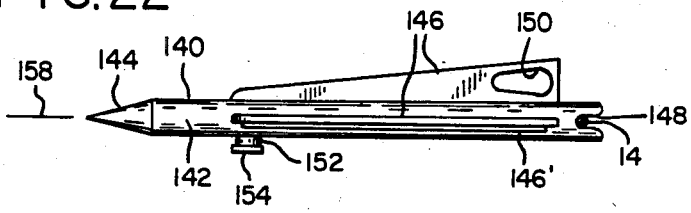
FIG. 22 is another form of projectile embodying principles of the present invention.
Figure 23:
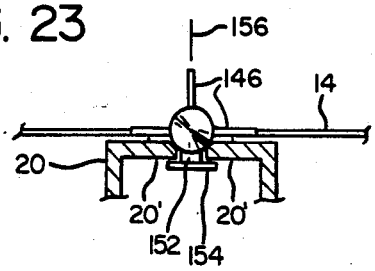
FIG. 23 is a sectional view of the projectile shown in FIG. 22.

Referring to FIGS. 22–24 a projectile 140 includes a body portion 142, a head 144, outwardly extending wings 146, a bowstring nock 148, an opening 150, and a downwardly extending portion 152. Such downwardly extending portion includes a laterally extending portion 154. The horizontal center of the projectile is indicated by line 156 and the vertical center of the projectile is indicated by line 158. In FIG. 23 the projectile 140 is shown in a loaded position on the top of the guide member 20.

The downwardly extending portion 152 is of such front to back length that it will pass between the parallel portions 20' when the projectile 140 is positioned on and transversely to the guide member.

Furthermore, the laterally extending portion 154 is wider than the gap between the parallel portions 20'. In a loaded position the laterally extending portions 154 engage the bottom of the parallel portions 20' as seen in FIG. 23.

To load the projectile 140 the operator positions the projectile transversely on the guide member 20, lowers the downwardly extending portion between the parallel portions 20', then rotates the projectile into alignment with the guide member. This locks the projectile onto the guide member while allowing its normal sliding movements. This important feature allows the projectile to be loaded into the top of the guide member and is shown in FIG. 24.

Another feature of this embodiment of the invention is that the projectile 140 can be unloaded from the guide member without sliding it through the front of such guide member. To unload this projectile the archer simply reverses the loading procedure, that is, he rotates the projectile from its position in alignment with the guide member to a position transverse to the guide member. This frees the projectile so that it can be removed from the guide member.

Furthermore, the projectile 140 can be interchangeably used with the conventional arrow 56 shown in FIG. 3, thus allowing the archer to selectively shoot either the projectile or the arrow.

The projectile 40 shown in FIG. 2, the projectile 80 shown in FIG. 14, and the projectile 140 shown in FIG. 22 may be interchangeably shot with the guide member 20 shown in FIG. 7, the guide member 70 shown in FIG. 13, the guide member 94 shown in FIG. 16 or the guide member 114 shown in FIG. 18.

The rearward bowstring engaging portions of the projectile embodiments shown in FIGS. 2, 14, 17 and 22 may be equipped with bowstring nocks suitable for vertically or horizontally positioned bowstrings and such projectiles may be used with other forms of shooting guides and archery bows.

The projectile 40 shown in FIG. 2, the projectile 80 shown in FIG. 14, the projectile 100 shown in FIG. 17 and the projectile 140 shown in FIG. 22 are substantially shorter than the distance between the front of the bow and the projectile engaging portion of the bowstring 14*a* when the bowstring is in a fully drawn position.

Projectiles shown in this disclosure may be loaded through the front ends of the guide members shown.

It is to be understood that the forms of my invention herein shown and described are to be taken as preferred examples of the same and that various other changes in the shape, size and arrangement of parts may be resorted to without departing from the spirit of my invention, or the scope of the subjoined claims.

Having thus described my invention, I claim:

1. In combination, a projectile and a shooting bow, said shooting bow comprising an elongated frame extending longitudinally in a shooting direction of the projectile, a pair of flexible arms with tip ends for providing tension in a bowstring, the pair of arms connected to the frame, a bowstring extending between the tip ends of the flexible arms, a bowstring catch and trigger mechanism on the frame for holding the bowstring in a drawn position and for releasing it to propel the projectile, an elongated projectile track extending longitudinally on the elongated frame in a shooting direction of the projectile, said projectile track including an elongated top portion and elongated opposite side portions, the top and side portions being substantially open to allow easy grasping of the projectile when it is loaded on the top of the projectile track, an elongated bar extending longitudinally over the top of at least a portion of the projectile when the latter is loaded on the top of the projectile track, the elongated bar allowing forwardly sliding movements of the projectile while restricting the latter's upwardly movements when it is propelled forwardly by the bowstring.

2. The combination of claim 1 wherein said elongated bar is cylindrical.

3. The combination of claim 1 wherein said projectile track comprises a pair of elongated cylindrical bars extending parallel to the shooting direction of the projectile, said pair of bars for slidably supporting the projectile therebetween.

4. The combination of claim 3 wherein said elongated bar is cylindrical and extends longitudinally over the pair of cylindrical bars.

5. The combination of claim 1 wherein the projectile includes multiple longitudinally extending wing portions and when the projectile is loaded onto the projectile track the elongated bar will extend longitudinally over one of the wing portions.

* * * * *